United States Patent [19]

Spengler

[11] Patent Number: 4,471,679

[45] Date of Patent: Sep. 18, 1984

[54] MODULAR FORCE APPLICATION DEVICE

[75] Inventor: Ernst M. Spengler, Heusenstamm by Ffm., Fed. Rep. of Germany

[73] Assignee: Stanztechnik GmbH R+S, Frankfurt, Fed. Rep. of Germany

[21] Appl. No.: 462,130

[22] Filed: Jan. 28, 1983

[30] Foreign Application Priority Data

May 8, 1982 [DE] Fed. Rep. of Germany ..... 3217348
May 8, 1982 [DE] Fed. Rep. of Germany ..... 3217349

[51] Int. Cl.[3] ..... B26D 5/12; B26D 7/26

[52] U.S. Cl. ..... 83/529; 83/562; 83/589; 83/598; 83/605; 83/639; 83/699; 83/700

[58] Field of Search ..... 83/529, 562, 589, 598, 83/605, 639, 699, 700

[56] References Cited

U.S. PATENT DOCUMENTS

| | | | |
|---|---|---|---|
| 3,230,812 | 1/1966 | Pucci et al. | 83/588 |
| 3,815,464 | 6/1974 | Frost | 83/639 |
| 4,106,379 | 8/1978 | Spengler | 83/639 X |
| 4,273,738 | 6/1981 | Spengler | 83/639 X |
| 4,277,996 | 7/1981 | Spengler | 83/171 |
| 4,286,490 | 1/1981 | Spengler | 83/453 |

*Primary Examiner*—Frank T. Yost
*Attorney, Agent, or Firm*—W. G. Fasse; D. H. Kane, Jr.

[57] ABSTRACT

A force is applied to a tool, such as a strip steel knife, a counter-holder or the like, through a linear pneumatic drive including a pressure expandable hose closed at its ends which expands in a given direction. The hose, a reaction plate and a force output plate extend in parallel to each other and through at least one modular reaction bail form a modular drive unit. Force transmission lever means extending at an angle to said given direction are operatively interposed between the force output plate and the tool for applying the force in a plane extending at an angle or in parallel to said given direction, whereby the compactness and versatility of a cutting apparatus employing such modular drive units is enhanced. These modular drive units, possibly in combination with modular drive units which apply the force in the direction of hose expansion, are adjustably supported by an exchangeable coordinate support frame structure to form a three-dimensionally effective stamping or cutting machine in which the cutting knives may cooperate with foaming molds, counter-holders or the like and wherein the linear pneumatic drives are supported in at least one plane, possibly in three planes formed by the coordinate support frame structure.

22 Claims, 13 Drawing Figures

106
105
105
108
88
88'
107
107
80'
109
109
84
85
104
81
87
102
103
103
56
110
27
30
23
28
31
17

FIG. 11
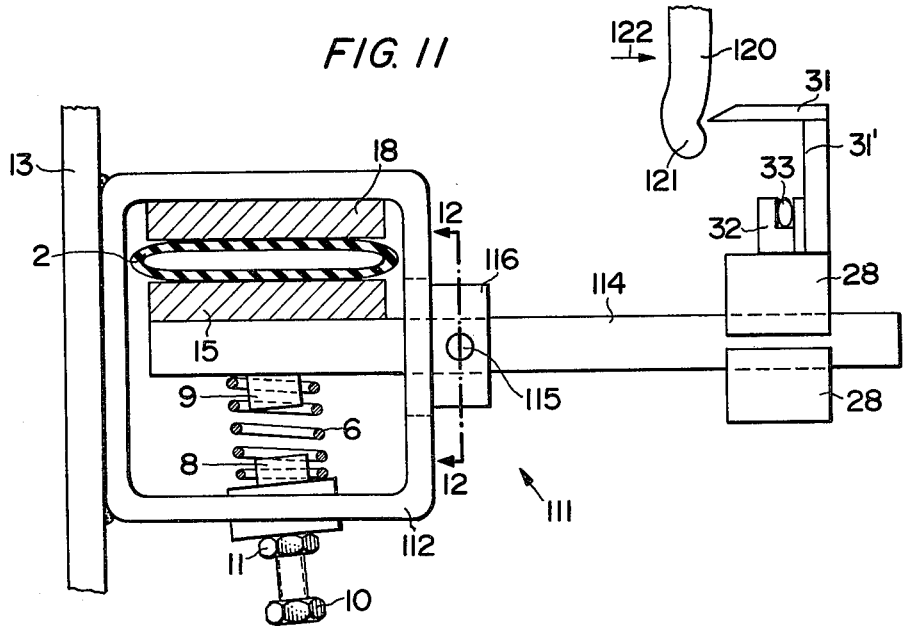
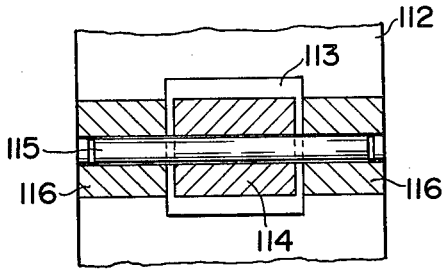
FIG. 12
FIG. 13
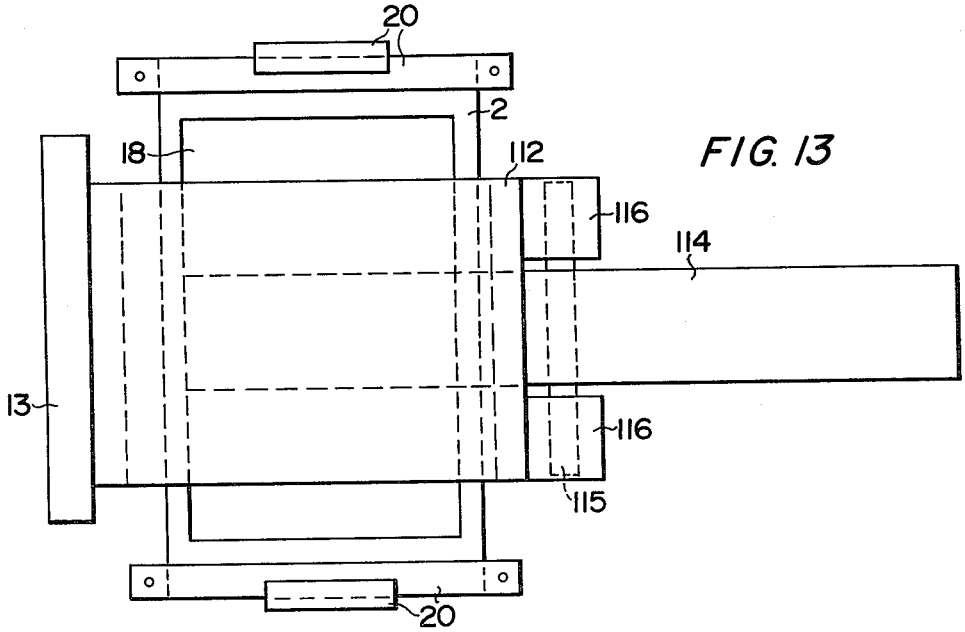

MODULAR FORCE APPLICATION DEVICE

CLAIM TO PRIORITY

The present invention is based on German Ser. Nos. P 32 17 348.2, filed in the Federal Republic of Germany on May 8, 1982 and P 32 17 349.0, filed in the Federal Republic of Germany on May 8, 1982. The priorities of the German filing dates are claimed for the present application.

BACKGROUND OF THE INVENTION

The present invention relates to a modular force application device in the form of linear pneumatic drives which may be secured to a coordinate frame structure for a three-dimensional cutting or shaping operation.

U.S. Pat. No. 4,286,490 discloses linear pneumatic drives in which the expansion of a hose extending through at least one, preferably through a plurality of modular bails, is used for applying a force along a line which may be straight or curved in a plane or in space. This type of drive is well suited for three-dimensional shaping or cutting operations. However, due to the fact that the power output takes place in the direction of the main hose expansion, there is room for improvement in the construction of such linear pneumatic drives.

U.S. Pat. No. 3,815,464 discloses a gas operated single stroke servomotor in which the expansion of a hose is employed to drive a knife edge through a restraining belt. Such a single stroke drive is not suitable for repeated cutting operations in a manufacturing process.

U.S. Pat. No. 3,230,812 discloses a punch press which is actuated by an expandable hose extending through two cooperating channels of substantially the same length as the hose. These channels do not form modular units which can be assembled along a common length of hose in any desired number and along any type of curve. These channels are effective only along a straight line. In one embodiment of U.S. Pat. No. 3,230,812 the hose expansion is transmitted to a plurality of punching tools through a like plurality of levers which are journalled to the frame which also supports the channel through which the hose extends. Such a structure is not compact and not adaptable for placing the individual, modular, linear pneumatic drive devices in a coordinate support frame structure.

U.S. Pat. No. 4,277,996 discloses a three-dimensional stamping or cutting apparatus with linear or pneumatic drives in which the cutting force is applied in the direction of expansion of a hose in response to introducing a gas under pressure into the hose. As mentioned above, this type of linear pneumatic drive is quite suitable for the intended purpose, but leaves room for improving the disposition of such linear pneumatic drive devices in a coordinate support frame structure.

It is also known to use piston cylinder drives in three-dimensional trimming machines, for example, for trimming preshaped carpets. The use of expandable hose means in a machine for exerting pressure onto a flat surface is also well known.

OBJECTS OF THE INVENTION

In view of the above it is the aim of the invention to achieve the following objects singly or in combination:

to provide a universally useful force application device in which the force is derived from the expansion of an expandable hose which may be applied to a plurality of modular units;

to provide a cutting apparatus capable of trimming complicated geometric three-dimensional shapes, such as interior vehicle components including inner door panels, dashboards, carpets, and the like;

to simplify the arrangement of a plurality of modular drive devices in a common coordinate frame structure so that the tools carried by these drive devices may reach all areas of a three-dimensional work piece without the need for intermediate retooling and without the need for moving the work piece from one machine to another;

to provide a modular force application device of the linear pneumatic type which is capable of reaching even those spots on a three-dimensional work piece which are most difficult to reach while simultaneously permitting the carrying of the drive devices on a coordinate support frame structure in a common plane; and to transmit the force exerted by the hose expansion by a lever mechanism in a direction extending substantially in parallel to the direction of hose expansion at least for relatively short power application strokes, or in a direction extending at an angle to the direction of hose expansion.

SUMMARY OF THE INVENTION

The modular force application device according to the invention comprises at least one modular stationary reaction bail with open sides for taking up a reaction force. The bail has a central axis which extends substantially perpendicularly to the open sides of the bail. A pressure expandable hose which is closed at its ends extends through the bail substantially in parallel or coaxially to the central axis. The hose is expandable by pneumatic pressure in a direction extending substantially perpendicularly to the central axis. Hose expansion transmission means such as a plate also extend in parallel to the hose through the bail. Force transmission lever means are directly journalled to the bail by suitable journal means so that the lever means extend with a first arm into direct cooperation with the hose expansion transmission means such as a plate. Reset means are arranged in the bail for cooperation with the first lever arm for returning the lever into a neutral position when the hose is not pressurized. A second lever arm extends away from the journal means and is suitable for securing a tool to the second lever arm. A plurality of such bails, levers and journals may be spaced along a single hose and along the hose expansion transmission means.

An advantage of the invention is seen in that the force may now be applied substantially in any direction extending at an angle relative to the direction of hose expansions, depending on the lever construction, for example in the form of a bellcrank type lever or in the form of a seesaw type lever. A strip steel knife secured, preferably adjustably, to the second lever arm will be moving along a circular path having its center in the journal axis of the lever means. However, the stroke required for most cutting or counter-holding operations is so short that such movement along a circular path is negligibly small.

Another advantage of the invention is seen in that the linear pneumatic drive devices can now be secured to a three-dimensional coordinate frame support structure in a single plane or, if required, in two or three planes extending at right angles relative to each other. Heretofore, it was necessary to secure the tools in many different positions extending at slanting angles relative to each other, requiring for example very precise welding operations which are now unnecessary.

According to the invention there is further provided a cutting or trimming apparatus for manufacturing three-dimensional work pieces in which a plurality of linear pneumatic force application devices are secured to a coordinate support frame structure in one or only a few planes extending perpendicularly to each other. Each of the linear pneumatic force application devices comprises an open-sided modular bail having a central axis and pressure expandable hose means extending through the bail substantially in parallel or coaxially to the central axis. A hose expansion plate extends also through the bail and parallel to the hose. Force output means are operatively supported directly by the bail for cooperation with the hose expansion transmission means for providing a power output in response to an expansion of the hose. Reset means are arranged for cooperation with the force output means for returning the latter into a neutral position when the hose is not pressurized. The coordinate support frame comprises position adjustable rails adjustably supported in the frame in at least one common plane in a coordinate grid pattern for holding the plurality of linear force application devices in an adjustable manner. The securing means for adjustably connecting the force application devices to the rails provide for a selective positioning of the force application devices within the coordinate grid pattern relative to a three-dimensional work piece, whereby even those areas of the work piece are now accessible to the tool which heretofore have not or only with difficulties been accessible on the same trimming machine.

With this type of coordinate frame structure, cuts may be made in any desired plane within a three-dimensional coordinate system, and under any required cutting angles, regardless of the shape of the work piece.

The linear pneumatic drive devices may carry so-called strip steel knives or they may carry counter-holders or any other tool which is required to be moved through a certain stroke length along a direction extending at any required angle relative to a three dimensional coordinate system.

BRIEF FIGURE DESCRIPTION

In order that the invention may be clearly understood, it will now be described, by way of example, with reference to the accompanying drawings, wherein:

FIG. 11 is a side view partially in section similar to that of FIG. 1, but showing a modified linear pneumatic drive according to the invention;

FIG. 12 is a sectional view along section line 12—12 in FIG. 11; and FIG. 13 is a top plan view onto the linear pneumatic drive according to FIG. 11, whereby the tool carrier has been omitted in FIG. 13.

DETAILED DESCRIPTION OF PREFERRED EXAMPLE EMBODIMENTS AND OF THE BEST MODE OF THE INVENTION

Figure 1:
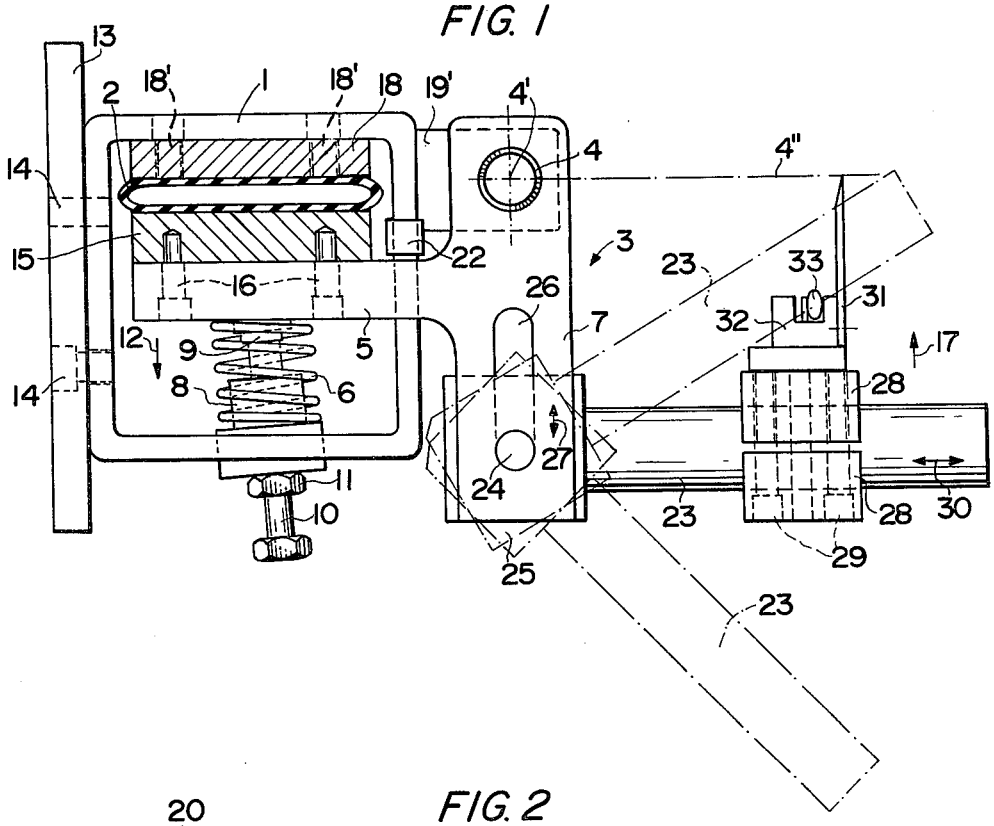
FIG. 1 is a side view partially in section through a linear pneumatic drive according to the invention.

FIG. 1 shows a side view of one embodiment of a linear pneumatic drive according to the invention, comprising a modular stationary reaction bail 1 which forms a closed ring with open sides through which a central axis extends substantially perpendicularly through the open sides and thus perpendicularly to the plane of the drawing. An expandable hose 2 of elastic material extends in parallel to the central axis. A force transmission lever means 3 is operatively secured directly to the stationary bail by journal means 4 for tilting about the journal axis 4' in response to an expansion of the hose 2 as will be described in more detail below. The lever means 3 have, for example, a bell-crank type shape and include first lever arms 5 and 5' as well as a second lever arm 7. Reset means 6 such as a spring cooperate with the lever arms 5, 5' for returning the force transmission lever means 3 into the shown neutral position when the hose 2 is not pressurized. The reset spring 6 is held in position by a stop member 8 and by a further stop member 9. The stop member 8 is adjustable in its position by a threaded screw bolt 10 and a counter or stop nut 11, whereby the spacing between the stop members 8 and 9 is adjustable to thereby determine or limit the stroke of the lever arms 5, 5' in the direction of the arrow 12. Preferably, the spring 6 and the stop members 8 and 9 extend at a slight slant relative to the horizontal as shown to accommodate the tilting movement of the arm 5.

Figure 2:
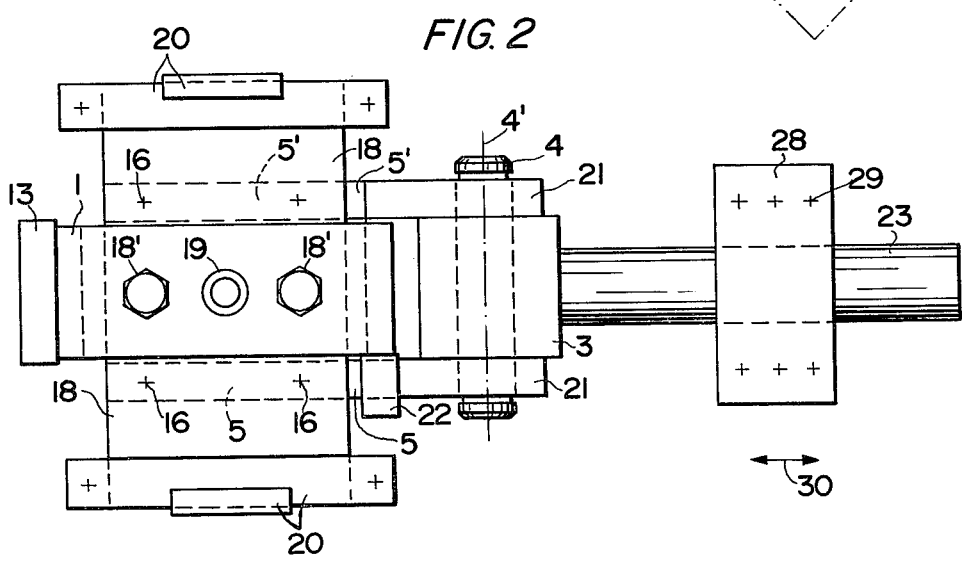
FIG. 2 is a top plan view of FIG. 1.

The bail 1 is secured to a machine frame member 13 for example by conventional screw means 14. The first lever arms 5 and 5' are spaced from each other as best seen in FIG. 2, whereby the bail 1 is received between these lever arms 5 and 5'. A hose expansion transmission means, for example, in the form of a longitudinal plate 15 is secured to the lever arms 5 and 5' by screws 16. Thus, when the hose 2 expands under pneumatic pressure introduced into the hose 2, substantially in the direction of the arrow 12, the lever arms 5, 5' will tilt also in the direction of the arrow 12 around the journal axis 4', thereby moving the second lever arm 7 in the direction of the arrow 17 which extends in the opposite direction to the arrow 12 and substantially in parallel to the arrow 12 for sufficiently small strokes. A force reaction plate 18 may be interposed between the bail 1 and the hose 2, whereby the latter is sandwiched between the two plates 15 and 18. The reaction plate 18 is secured to the bail by screws 18'. A pressurized gas is admitted to the hose through a port 19 not shown in detail in FIG. 1, but only in FIG. 2. The ends of the hose 2 are closed in a pressure-tight manner by clamping means 20.

The journal means comprise a journal bolt 4 held in position by two journal brackets 21 rigidly and directly secured to the bail 1, for example by welding as best seen in FIG. 2. A stop member 22 is also welded to the bail 1 for limiting the upward movement of the lever arms 5, 5'.

A tool holder 23 is operatively secured to the second lever arm 7, preferably in a position adjustable manner, whereby the tool holder 23 may take up a plurality of different positions shown in dash-dotted lines in FIG. 1. These different positions of the tool holder 23 extend at an angle relative to the vertical. For this purpose a screw bolt 24 extends through mounting plates 25 and through a longitudinal slot 26 in the second lever arm 7. Thus, the tool holder 23 is not only adjustable angularly, but also its position relative to the lever arm 7 is adjustable up and down along the arrow 27. Once the tool holder 23 is adjusted to the proper position, the plates 25 which are rigidly secured to the tool holder 23 may be welded to the lever arm 7. A tool carrying clamp 28 held together by screws 29 is also adjustable back and forth along the tool holder 23 as indicated by the arrow 30. Thus, the adjustment possibilities for positioning a strip steel knife 31 are very versatile due to the just described three adjustments. The knife 31 is conventionally secured to a block 32 which in turn is held by the clamp member 28. Electrical heating members 33 may also be held by the block 32 for keeping the knife 31 at a predetermined temperature to facilitate the cutting operation as is conventional. The tip of the knife 31 is preferably located in the same plane 4'' as the journal axis 4' since in this position any effect of the knife moving along a circular path through a material of given thickness is minimized. The plane 4'' extends substantially perpendicularly to a plane through said central axis of the bail 1. Both planes extend perpendicularly to the plane of the drawing.

The operation of the present linear pneumatic drives is rather simple and hence not subject to jamming which is completely prevented by the journal movement of the force transmission lever 3 around the journal shaft 4 in response to an expansion of the hose 2 and in response to the force of the resetting spring 6 when the hose 2 is not pressurized.

Figure 3:
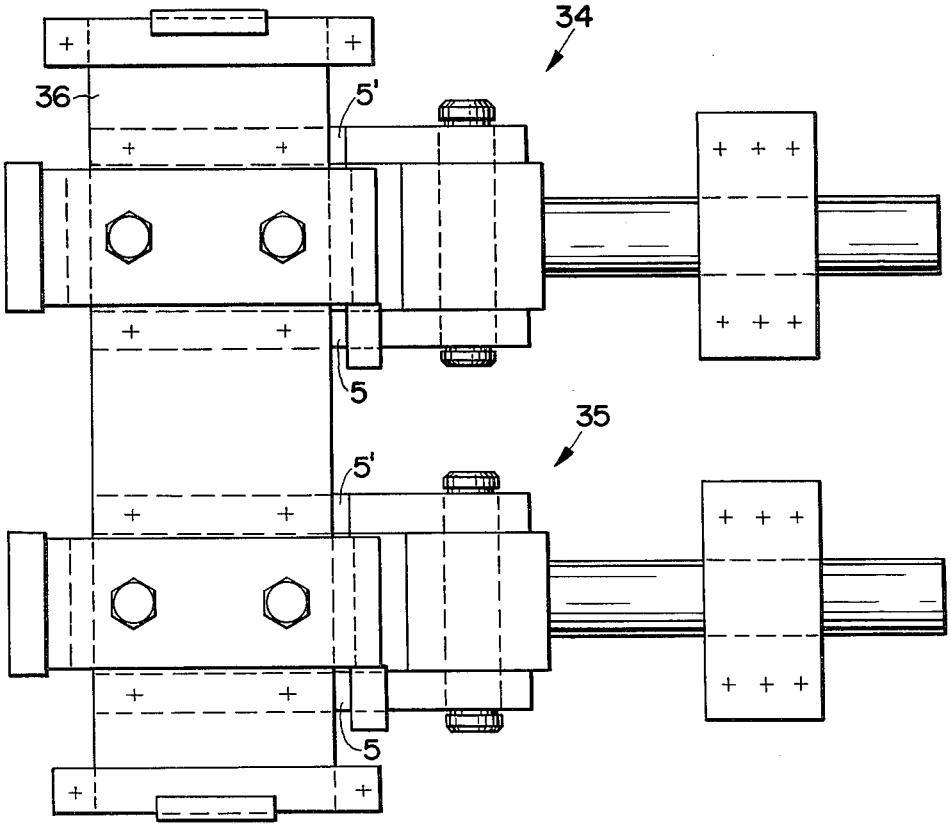
FIG. 3 is a top plan view similar to that of FIG. 2, however, showing two linear pneumatic drives operated by a common expandable hose.

FIG. 3 shows how two linear pneumatic drive units 34 and 35 are arranged alongside each other for actuation by a common expandable hose not seen in FIG. 3, but arranged as disclosed in FIG. 1. According to the invention it is possible to arrange any desired number of bails along a common hose sandwiched between a common reaction plate 36 and a hose expansion transmission plate also not shown in FIG. 3, but arranged as shown in FIG. 1.

Figure 4:
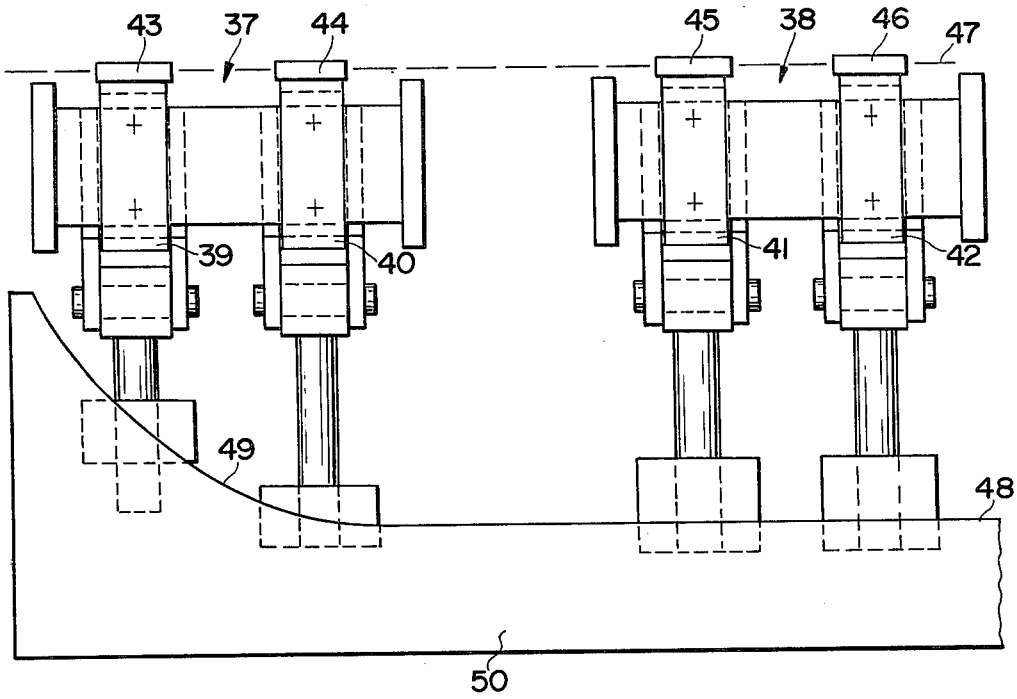
FIG. 4 is a side elevational view of two linear pneumatic drives supported in a common plane even though one drive carries a curved knife.

FIG. 4 illustrates the positioning of two linear pneumatic drive units so that the respective bails 39, 40, 41 and 42 are all connected to machine frame members 43, 44, 45 and 46 which define a common plane 47. In spite of this connection of the linear pneumatic drive units to the machine frame, they are able to carry strip steel knives 48 and 49 which extend perpendicularly to the plane of the drawing and which may be curved as shown for the strip steel knife 49 to thereby cut a work piece 50 having a corresponding curved shape in space. The two cutting or trimming knives 48, 49 may even reach into a back cut zone of the work piece 50.

Figure 5:
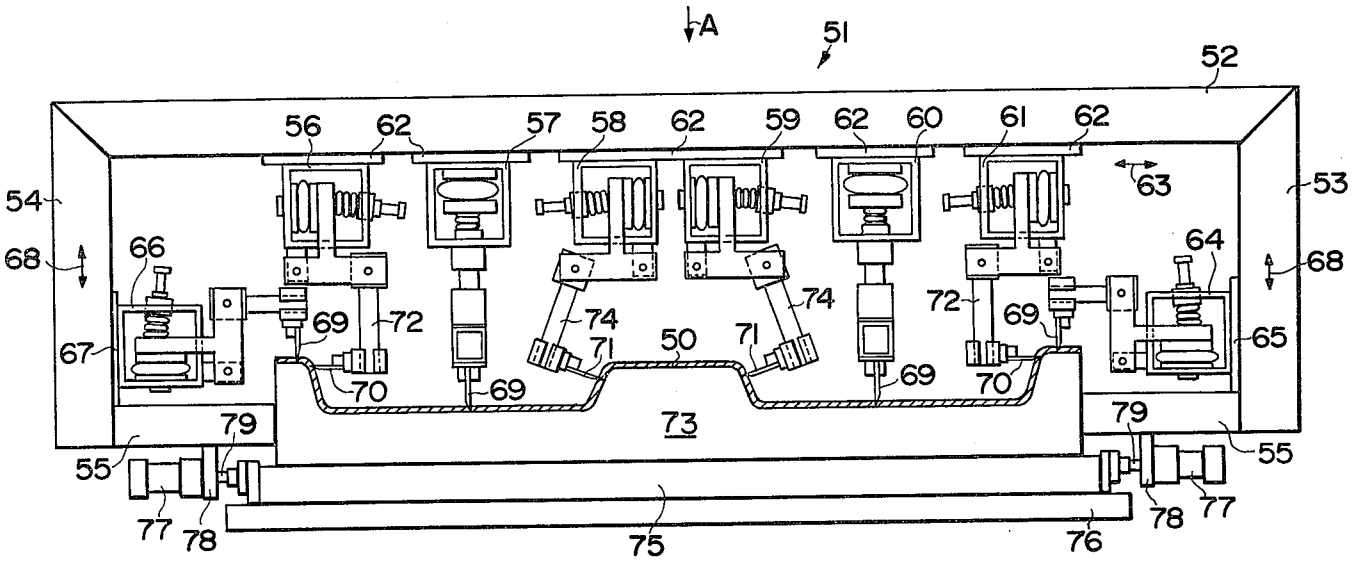
FIG. 5 is a simplified side view of a coordinate support frame structure carrying a plurality of linear pneumatic drive devices in three planes, two of which extend in parallel to each other and perpendicularly to the third plane in a three-dimensional coordinate system.

FIG. 5 illustrates the connection of a plurality of linear pneumatic drives to a coordinate support frame structure 51 having a top frame component 52, a right side frame component 53, a left side frame component 54, and a bottom frame component 55 forming a cage type support frame structure for the linear pneumatic drive units. Six linear pneumatic drive units 56, 57, 58, 59, 60, and 61 are position adjustably secured to the top frame component 52 by means of rails 62 to be described in more detail below. The drive units 56 to 61 are adjustable along the rails 62 in a direction extending perpendicularly to the plane of the drawing. The rails 62 in turn are adjustable horizontally relative to the top frame component 52 as indicated by the arrow 63. The right frame component 53 carries a further drive unit 64 secured to a rail 65. The left frame component 54 carries a further linear pneumatic drive unit 66 on a rail 67. The rails 65 and 67 are adjustable vertically up and down as indicated by the arrow 68. Additionally, the drive units 64 and 66 are adjustable in directions extending perpendicularly into the plane of the drawing along the rails 65 and 67.

The linear pneumatic drive units 56, 58, 59 and 61 as well as 64 and 66 are all constructed as described above with reference to FIGS. 1 and 2. The linear pneumatic drive units 57 and 61 are of the type as disclosed in my above mentioned U.S. Pat. No. 4,286,490. components 52, 53, 54 define respective planes.

The coordinate support frame structure 51 as disclosed herein now makes it possible in combination with the linear pneumatic drives of the present invention to arrange these drives so that they all are connected to a common plane or to several planes extending at right angles to each other in a three-dimensional coordinate system, whereby the tooling and retooling as well as the precision position adjustment has been greatly facilitated. For example, the knives 69 may cut substantially vertically into a work piece 50, while the knives 70 cut substantially horizontally into the same work piece. The knives 71 cut at an angle into the same work piece 50. Further, for example, the knives 70 carried by the tool holder 72 may be adjusted vertically up and down as has been described above with reference to FIGS. 1 and 2. The angular adjustment of the knives 71 carried by the tool holders 74 is additionally possible also as described above.

The work piece 50 rests on a mold type tool member 73 which in turn is supported on a stamping table 75 forming part of a support structure 76 such as a lifting mechanism or a conveyor or the like. The bottom frame component carries locking means 77 on brackets 78 for locking the coordinate support frame structure 51 to the table 75 of a stamping machine. A piston rod 79 is movable into a respective recess in the table 75, whereby the stamping forces can be introduced directly into the machine frame. Further, by withdrawing the piston rod 79 from the table 75, the entire coordinate support frame structure 51 may be lifted off the table 75 and replaced, for example, by another frame structure which has been retooled in the meantime.

Figure 6:
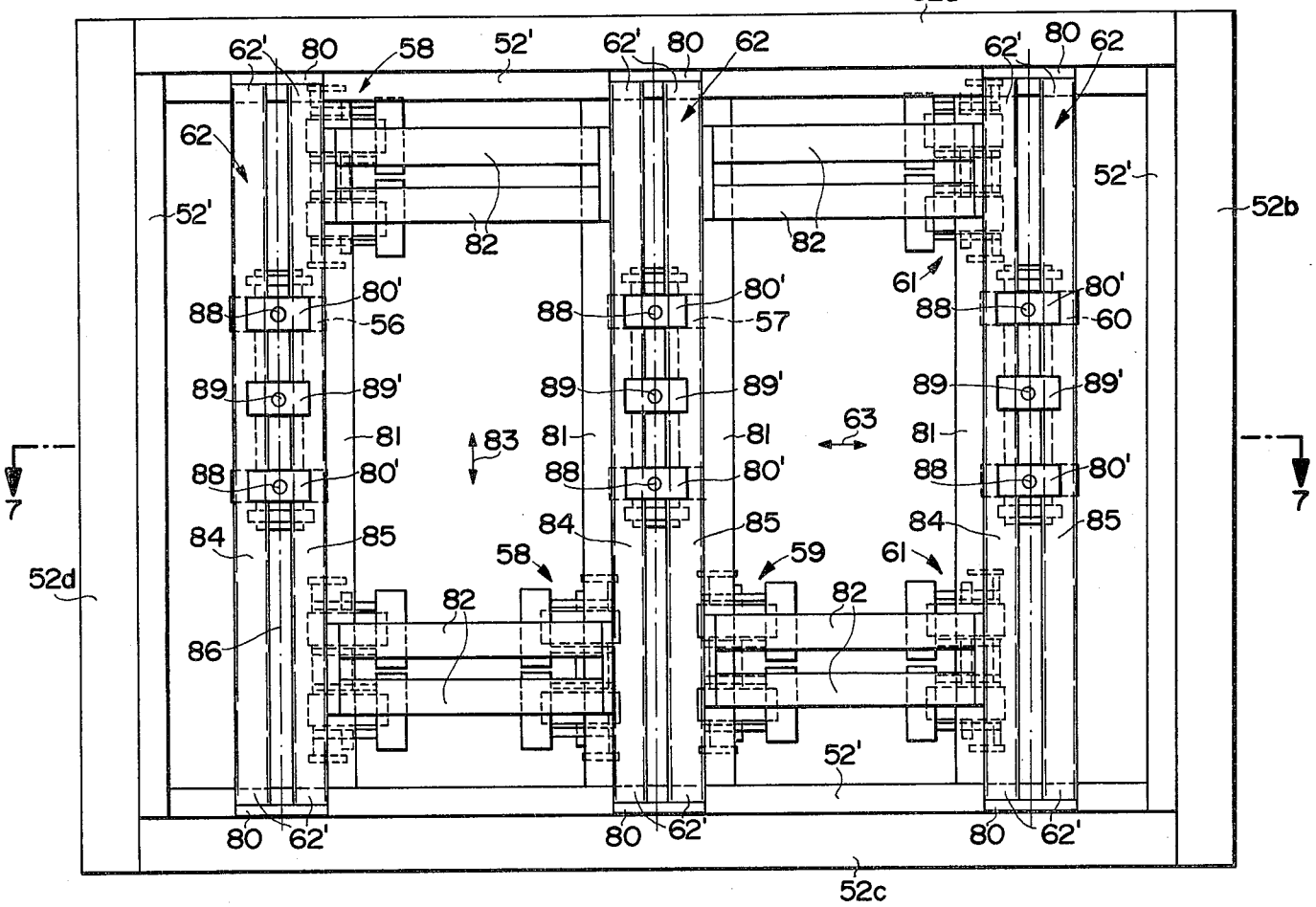
FIG. 6 is a top plan view onto a coordinal frame structure similar to that of FIG. 5 as viewed in the direction of the arrow A is FIG. 5.

FIG. 6 shows a top plan view in the direction of the arrow A in FIG. 5. The top frame component 52 comprises four rail members **52*a*, 52*b*, 52*c* and 52*d*. These rail members are welded together to form a rectangular frame component. Although six rails 62** are shown in FIG. 5, only three such rails are illustrated in FIG. 6 for simplicity's sake. The rail members 52*a*, 52*b*, 52*c*, and 52*d* are each provided with a respective inwardly facing or reaching guide flange 52'. As shown, the rails 62 rest with their ends 62' on the upper and lower guide flanges 52' for a position adjustment horizontally in the direction of the arrow 63. Once the proper position is established, screws not shown extending through tying plates 80 into threaded holes in the flanges 52' permit tying down the rails 62 in the desired position. Any conventional clamping mechanism may be used to clamp the rails 62 to the flanges 52'. The rails 62 may be provided with one guide flange 81 as shown in the left and right hand portions of FIG. 6 or they may be provided with two guide flanges 81 as shown in the center of FIG. 6. Further rail members 82 are slidable back and forth along these flanges 81 as indicated by the arrow 83. Each of these rails 62, 82 may carry one or more linear pneumatic drive units 56 to 61 as shown. These drive units are also adjustable along the rails as will be described in more detail below. Further, it is not necessary that the rails 62 are oriented vertically as shown. These rails 62 may also be oriented horizontally, whereby the length of the rails 62 would be sufficient so that the ends of these rails could rest on the left and right guide flange 52'. The position adjustable connecting means for securing the linear pneumatic drive units to the several rails will be described below.

Figure 7:
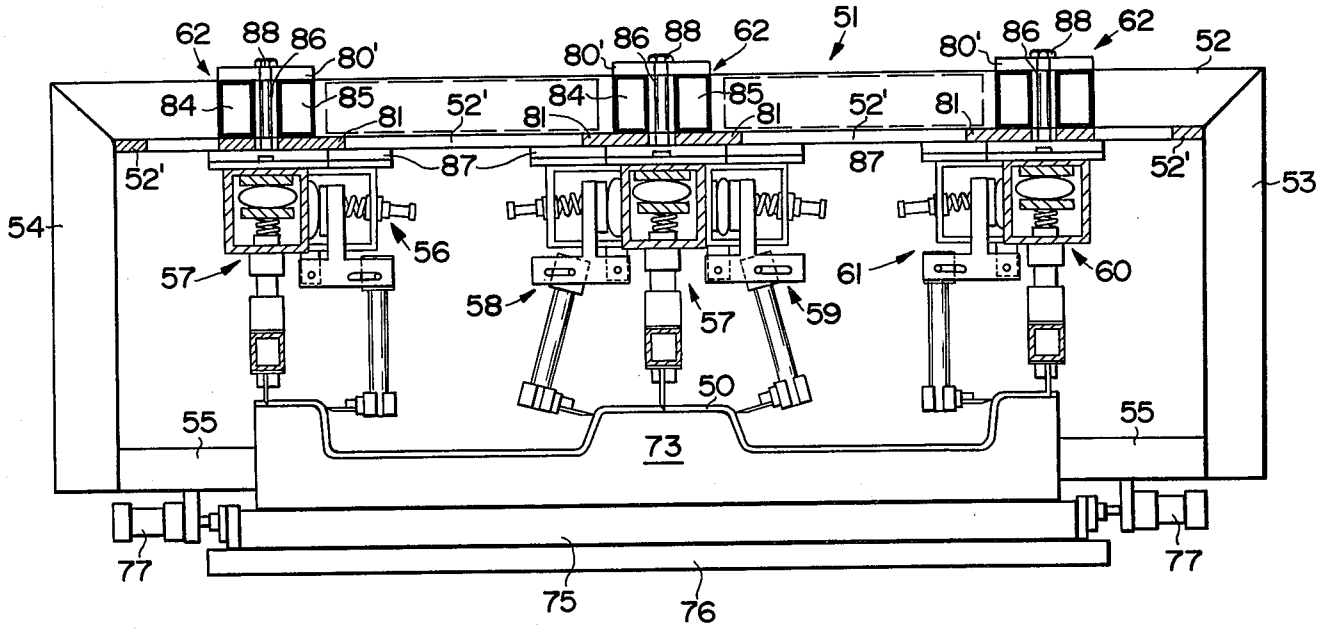
FIG. 7 is a view similar to that shown in FIG. 5, partially in section, along a section plane indicated by the section line 7—7 in FIG. 6.
Figure 8:
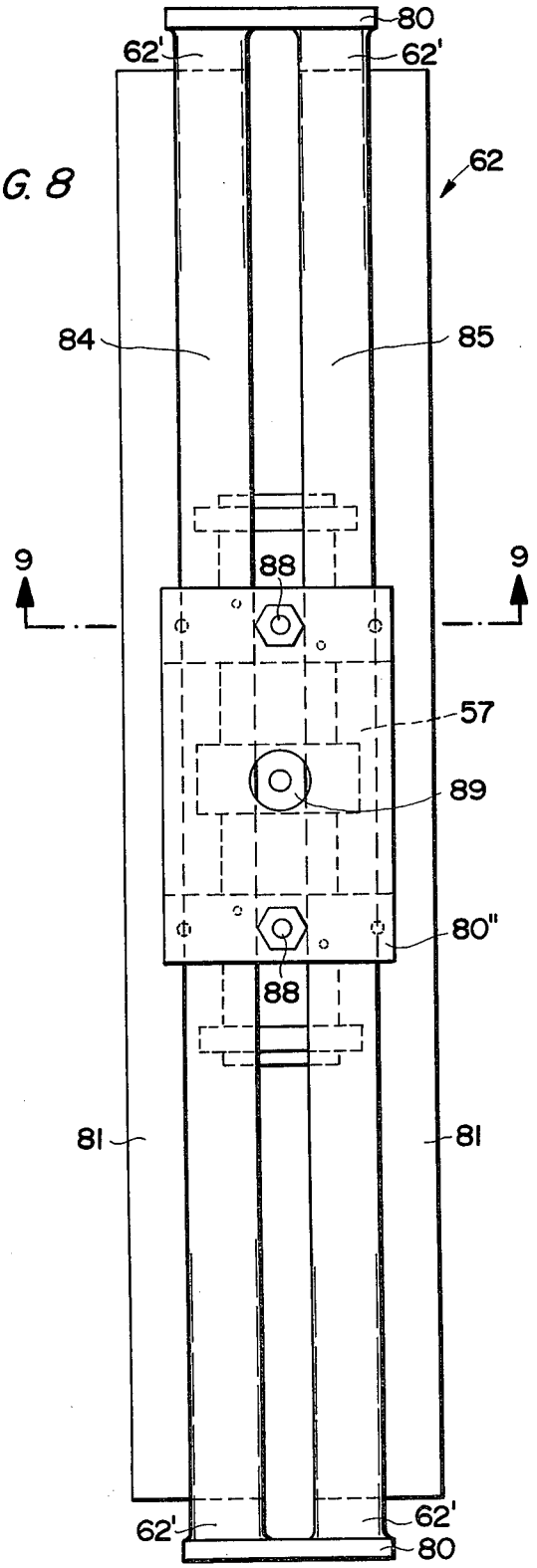
FIG. 8 is a top plan view of a rail structure for adjustably supporting one or more linear pneumatic drives in the coordinate frame structure shown in FIGS. 5, 6 or 7.

In FIG. 7 the same reference numbers are being used for the same components as in FIGS. 5 and 6. The position of the various linear pneumatic drive units does not necessarily correspond from figure to figure to thereby indicate the versatility in the adjustment of the drive units in their position while they are nevertheless being held in a common plane defined by the top frame component 52. The carrying rails supported by the right and left frame components 53 and 54 are not shown in FIGS. 6 and 7 in order not to make these illustrations too complicated. The rail structure is the same as of the rail 62 supported by the top frame component 52. The same applies for the horizontally extending rail members 82. Thus, each rails 62 comprises for example, two rail elements 84 and 85 spaced so as to leave a gap 86 therebetween. The clamping screw 88 reaches through the clamping plate 80' and through the gap 86 into a spacer 87 to which the individual bails are attached. In order to avoid any rotation of the individual drive units, several clamping plates 80' may be used or a larger clamping plate 80'' with two clamping screws 88 may be used as shown in FIG. 8. The same reference numbers are employed in FIG. 8 as in FIG. 6. A so-called quick coupling 89 may be used for connecting the expandable hose sections to a source of pneumatic pressure. The discharge of the pressurized gas from the hose may take place through the same coupling or through a different opening not shown. A plate 89' holds the quick coupling 89.

Figure 9:
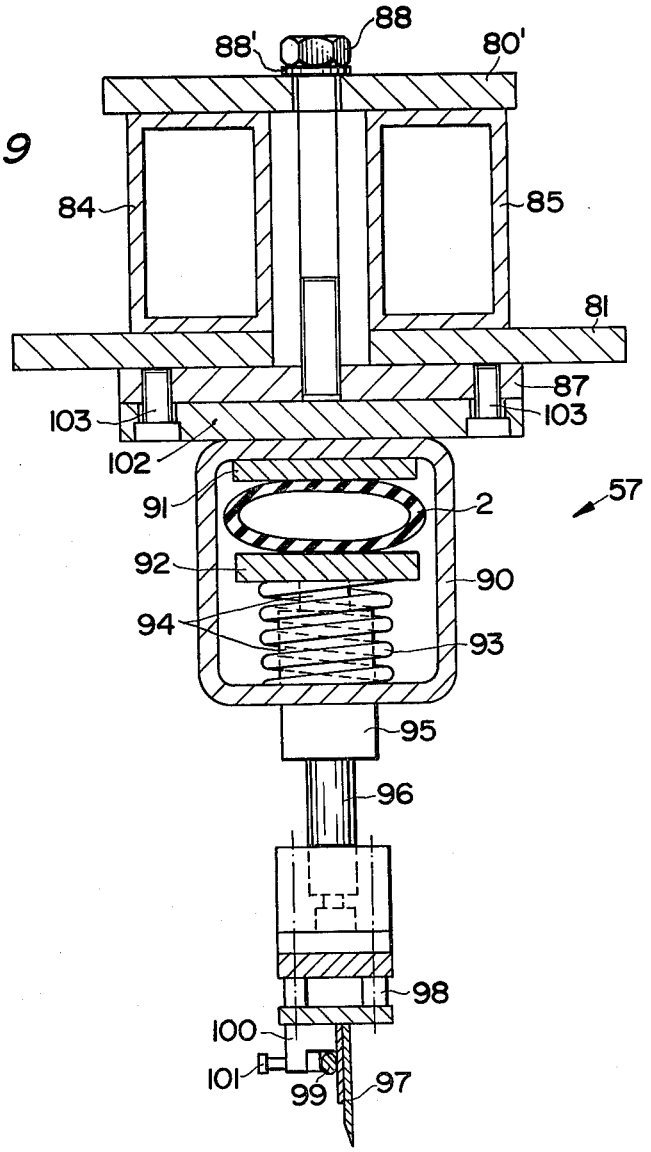
FIG. 9 is a sectional view along section line 9—9 in FIG. 8.

FIG. 9 illustrates on an enlarged scale a sectional view through a linear pneumatic drive such as shown at 57 in FIG. 7 and also disclosed in my U.S. Pat. No. 4,286,490. A hose 2 passes through an open-sided bail 90 between a reaction plate 91 and a hose expansion transmission plate 92. A reset spring 93 returns the hose into its neutral position when the hose is not pressurized. Stop members 94 limit the stroke. A guide bushing 95 guides the power transmission rod 96. A tool such as a strip steel knife 97 is secured to the rod 96 through spacer means 98. An electrical knife heater 99 is conventionally secured to the knife holder 100 for example, by screws 101. The bail 90 is welded to a frame member 102 which in turn is secured by screws 103 to the spacer 87 provided with a threaded hole for cooperation with the threaded end of the clamping screw 88 which is pressing against a lock washer 88'.

Figure 10:
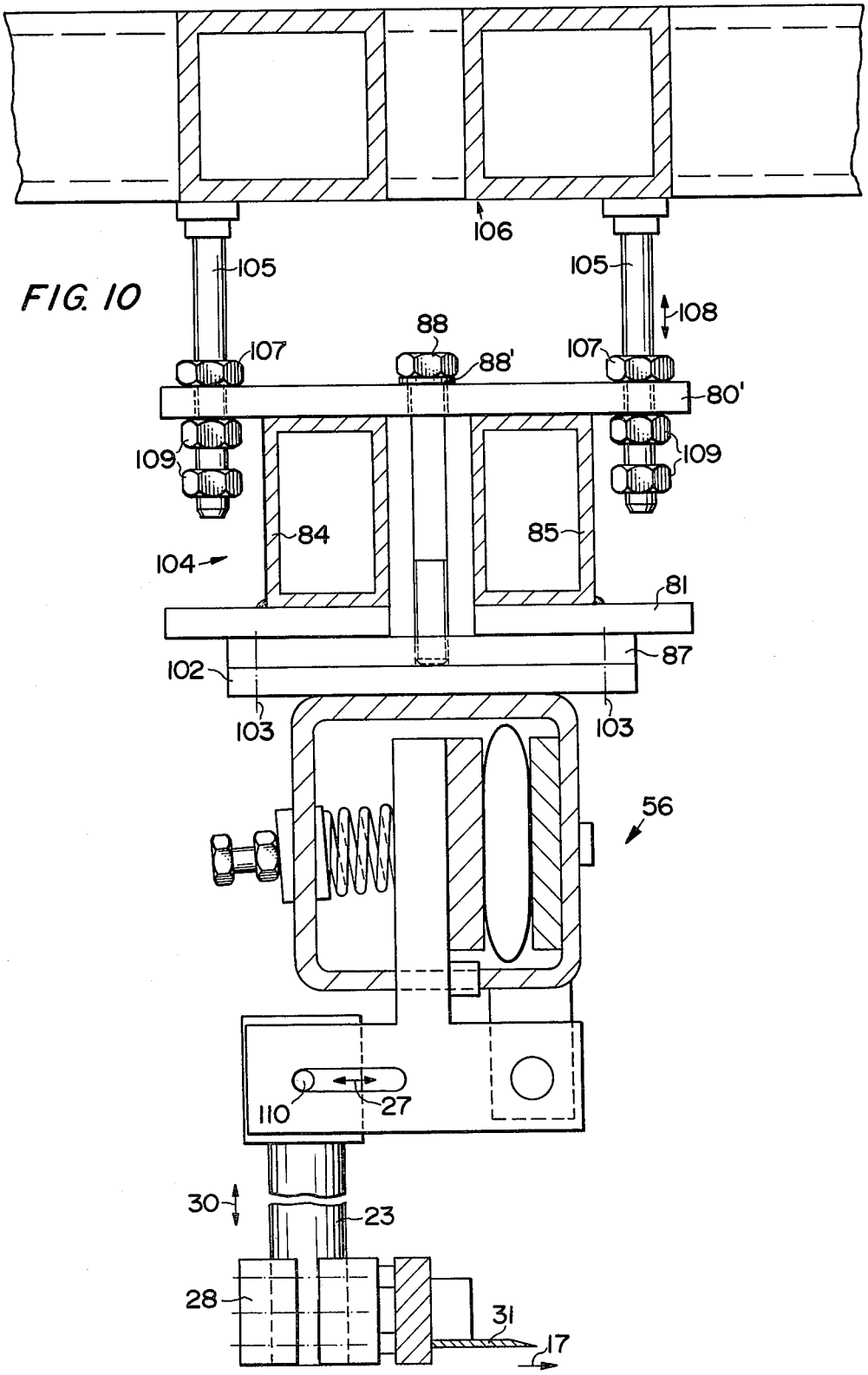
FIG. 10 is a sectional view similar to that shown in FIG. 9, however, showing a modified support structure for a linear pneumatic drive.

FIG. 10 shows the connection of a linear pneumatic drive, for example 56, according to the invention, to a first position adjustment rails structure 104 which in turn is connected through spacer bolts 105 to a further rail structure 106, for example forming a machine frame. Threaded nuts 107 are adjustable up or down along the bolts 105 as indicated by the arrow 108, whereby the entire drive unit 56 with the rail structure 104 may be adjusted in its elevational position. Additionally, the position of the strip steel knife 31 is adjustable as has been described above with reference to FIG. 1 and the arrows 17, 27 and 30. The arrow 17 in FIG. 10 indicates the angular adjustment of the tool holder 23 around the journal pin 110.

FIGS. 11, 12 and 13 show a linear pneumatic drive 111 with a structure quite similar to that shown in FIGS. 1 and 2. Thus, the same components are provided with the same reference numbers. The bail 112 has a hole 113 in one of its side legs through which a lever 114 extends directly into the bail and into contact with the hose expansion transmission plate 15. The lever 114 is journalled directly to the bail 112 by a journal shaft 115 held in a journal block 116. The operation of the embodiment illustrated in FIGS. 11, 12 and 13 is substantially the same as that of the linear pneumatic drive shown in FIGS. 1 and 2. Any jamming is again avoided due to the journalling of the lever arm 114 directly to the bail. The lever arm 114 may be round, square, or rectangular. The same, incidentally, applies to the tool holder 28.

The embodiment of FIG. 11 may be used with the knife 31 extending at a right angle to the lever 114. However, a more advantageous use of the embodiment of FIG. 11 may be made by securing the knife 31 to a spacer 31', whereby the knife 31 extends substantially in parallel to the lever 114 for moving the knife 31 into positions which are difficult to reach with conventional tools relative to a work piece 120. Thus, the knife 31 may even reach behind an overhang 121 of the work piece 120 which is then pressed against the knife edge by a force effective in the direction of the arrow 122 as shown.

Although the invention has been described with reference to specific example embodiments, it will be appreciated, that it is intended to cover all modifications and equivalents within the scope of the appended claims.

What is claimed is:

1. A modular force application device comprising a modular stationary reaction bail with open sides for taking up a reaction force, said bail having a central axis extending substantially perpendicularly to said open sides, pressure expandable hose means extending through said bail substantially in parallel to said central axis and expandable substantially perpendicularly to said central axis, hose expansion transmission means also extending through said bail in parallel to said hose means, force transmission lever means, journal means journalling said lever means to said bail, said lever means having a first lever arm extending from said journal means into direct cooperation with said hose expansion transmission means, reset means arranged in said bail for cooperation with said first lever arm for returning said lever means into a neutral position when said hose means are not pressurized, and wherein said lever means have a second lever arm extending away from said journal means for securing tool means to said second lever arm, whereby a plurality of such bails, lever means and journal means may be spaced along said hose means and along said hose expansion transmission means.

2. The device of claim 1, comprising a first pressure reaction plate extending in parallel to said hose means through said bail between the hose means and the bail, said hose expansion transmission means comprising a second force output plate extending in parallel to said first plate, whereby the hose means is sandwiched between the first and second plates.

3. The device of claim 1, wherein said force transmission lever means comprise a bell-crank type lever having a T-configuration with a head bar and a shank, said shank forming said first lever arm, one end of said head bar being journalled to said journal means secured to said bail, the other end of said head bar forming said second lever arm for connecting tool means to said second lever arm.

4. The device of claim 3, further comprising tool means, a tool holder bar, first means for position adjustably securing said tool means to said tool holder bar, second means for position adjustably securing said tool holder bar to said head bar of said T-configuration.

5. The device of claim 1, further comprising tool means and means for position adjustably securing said tool means to said second lever arm.

6. The device of claim 1, wherein said first lever arm has a U-configuration with two arm portions and a spacing between the arm portions, said modular bail extending into said spacing for cooperation between said arm portions of said first lever arm and said hose expansion transmission means.

7. The device of claim 1, wherein said modular bail has a top and bottom wall and two side walls, one side wall having a hole therein through which said first lever arm extends into the bail for cooperation between said first lever arm and said hose expansion transmission means.

8. The device of claim 1, wherein said reset means comprise adjustable threaded means for adjusting the range of the tilting movement of said first lever arm in one direction and stop means arranged for limiting the tilting movement of the first lever arm in the opposite direction.

9. The device of claim 1, wherein said bail is a section of rectangular tubular stock, said bail section having two wall portions any one of which is securable to a machine frame.

10. The device of claim 1, wherein said pressure expandable hose means comprise a length of hose and two clamp means closing the ends of the hose length in a pressure-tight manner.

11. The apparatus of claim 1, wherein journal means (4) for said lever means (3) have a fixed journal axis (4') extending in a given plane (4'') which extends substantially perpendicularly to a plane through said central axis, said apparatus further comprising tool means including a strip steel knife having a knife edge reaching substantially to said given plane (4'') for minimizing any effect of a knife movement along a circular path.

12. The apparatus of claim 1, further comprising tool means in the form of a strip steel knife, and means securing said strip steel knife to said second lever arm so that the strip steel knife extends substantially in parallel to said lever arm (114).

13. An apparatus for cutting or trimming three-dimensional work pieces, comprising a plurality of linear pneumatic force application devices, each of said devices comprising an opensided modular bail having a central axis, pressure expandable hose means extending through said bail substantially in parallel to said central axis, a hose expansion transmission means also extending through said bail in parallel to said hose means, force output means operatively supported directly by said bail for cooperation with said hose expansion transmission means for providing a power output in response to an expansion of said hose means, and reset means cooperating with said force output means for returning the force output means into a neutral position when said hose means are not pressurized, a coordinate support frame structure, position adjustable rail means adjustably supported in said frame structure in at least one common plane in a coordinate grid pattern for holding said plurality of linear force application devices, and securing means adjustably connecting said force application devices to said rail means for selectively positioning said force application devices within said coordinate grid pattern relative to a three-dimensional work piece.

14. The apparatus of claim 13, wherein said force application devices further comprise a reaction plate extending inside said bail in parallel to said hose means opposite said hose expansion transmission plate.

15. The apparatus of claim 13, wherein said force application output means comprise lever means and journal means journalling said lever means to said bail, said lever means having a first lever arm extending from said journal means into direct cooperation with said hose expansion transmission means, said lever means having a second lever arm extending away from said journal means for securing tool means to said second lever arm, whereby the direction of force application extends substantially in parallel to the direction of hose expansion for relatively small strokes.

16. The apparatus of claim 13, wherein said force application output means comprise a rod rigidly secured to said hose expansion transmission plate and a guide bushing rigidly secured to said bail so that said rod extends through the guide bushing out of the bail, whereby the direction of force application extends substantially in the direction of hose expansion.

17. The apparatus of claim 13, wherein said position adjustable rail means comprise a plurality of rail members arranged in parallel but spaced pairs to provide a gap between two rail members forming a pair, and wherein said securing means comprise threaded bolt means extending through said gap and directly or indirectly into threaded holes in said bail and a clamping plate means through which the threaded bolt means extend, said clamping plate means bridging said gap, whereby said linear force application device is adjustable in its position along the respective pair of rail members when the bolt means are loosened and fixed in an operating position when the bolt means are tightened.

18. The apparatus of claim 17, further comprising spacer plate means operatively interposed between said bail and said coordinate frame structure.

19. The apparatus of claim 17, further comprising suspension means for securing said pairs of rail members at a spacing from said coordinate support frame structure.

20. The apparatus of claim 13, further comprising locking means for releasably securing said coordinate support frame structure to a machine frame or table, whereby the coordinate support frame structure is exchangeable as a unit.

21. The apparatus of claim 13, further comprising tool means and means position adjustably connecting said tool means to said force output means for adjusting the position of the respective tool means relative to a work piece.

22. The apparatus of claim 13, wherein said frame structure comprises lateral frame components, wherein said position adjustable rail means comprise lateral rail members which are position adjustable between two lateral frame components, and wherein said linear pneumatic force application devices comprise such devices which are secured to said lateral rail members, whereby said devices are held in a plurality of planes extending at right angles in a three-dimensional coordinate system defined by said frame structure.

* * * * *